US011633315B2

(12) United States Patent
Schmutz

(10) Patent No.: US 11,633,315 B2
(45) Date of Patent: Apr. 25, 2023

(54) SAFE BED SYSTEM

(71) Applicant: Freedom Medical, Inc., Exton, PA (US)

(72) Inventor: Jeffrey Allen Schmutz, New Hope, PA (US)

(73) Assignee: Freedom Medical, Inc., Exton, PA (US)

( * ) Notice: Subject to any disclaimer, the term of this patent is extended or adjusted under 35 U.S.C. 154(b) by 0 days.

(21) Appl. No.: 17/189,187

(22) Filed: Mar. 1, 2021

(65) Prior Publication Data

US 2021/0267827 A1 Sep. 2, 2021

Related U.S. Application Data

(60) Provisional application No. 62/982,981, filed on Feb. 28, 2020.

(51) Int. Cl.
*A61G 7/05* (2006.01)
*A61G 7/00* (2006.01)

(52) U.S. Cl.
CPC ..... *A61G 7/0522* (2016.11); *A61G 7/052* (2016.11); *A61G 7/0507* (2013.01)

(58) Field of Classification Search
CPC ..... A61G 7/0522; A61G 7/052; A61G 7/0507
USPC ..... 5/427, 428, 425, 424
See application file for complete search history.

(56) References Cited

U.S. PATENT DOCUMENTS 3,742,530 A * 7/1973 Clark ..... A61G 7/0522 5/663
3,995,846 A * 12/1976 Frick ..... A61F 15/005 5/648
4,215,446 A * 8/1980 Mahoney ..... A61G 7/052 5/663
4,232,415 A * 11/1980 Webber ..... A61G 7/052 5/512
4,370,765 A * 2/1983 Webber ..... A47C 21/08 5/663
4,628,557 A * 12/1986 Murphy ..... A47C 27/20 5/724
4,827,545 A * 5/1989 Arp ..... A61G 7/0522 5/663
4,843,666 A * 7/1989 Elesh ..... A47C 27/144 5/738
5,044,025 A * 9/1991 Hunsinger ..... A61G 7/052 5/663
5,097,550 A * 3/1992 Marra, Jr. ..... A61G 7/0522 5/663
5,175,897 A * 1/1993 Marra, Jr. ..... A61G 7/0524 5/663
5,191,663 A * 3/1993 Holder ..... A61G 7/0524 5/663
5,481,772 A * 1/1996 Glynn ..... A61G 7/052 5/663
5,890,244 A * 4/1999 Cartwright ..... A61G 7/0522 5/663

(Continued)

*Primary Examiner* — Robert G Santos

(57) ABSTRACT

A pad assembly for an occupant platform having rails. The pad assembly includes a foam pad comprising an outward portion that covers an outward face of one rail and a top portion that covers a top end of the one rail. The pad assembly also includes an inner casing that encases and is attached to the foam pad and an outer cover that covers the inner casing. The outer cover has a fastener for securing the pad assembly to the one rail.

19 Claims, 7 Drawing Sheets

(56) References Cited

U.S. PATENT DOCUMENTS

| | | | | |
|---|---|---|---|---|
| 6,038,721 | A * | 3/2000 | Gordon | A61G 7/052 5/663 |
| 6,820,293 | B2 * | 11/2004 | Alverson | A61G 7/0507 5/663 |
| 2004/0060111 | A1 * | 4/2004 | Alverson | A61G 7/0524 5/425 |
| 2021/0267827 | A1 * | 9/2021 | Schmutz | A61G 7/0522 |

* cited by examiner

SAFE BED SYSTEM

CROSS REFERENCE TO RELATED APPLICATIONS

This application also claims the benefit of U.S. Provisional Application No. 62/982,981, filed Feb. 28, 2020. The entire disclosure of which is incorporated herein by reference.

STATEMENT REGARDING FEDERALLY SPONSORED RESEARCH OR DEVELOPMENT

The present invention was not developed with the use of any Federal Funds, but was developed independently by the inventors.

BACKGROUND

Field

The present invention pertains to sculpted, high-density foams, and durable textiles to produce a padding system which is thicker, and more impact resistant than previously created, while being aesthetically pleasing, and form-fitting a specific hospital bed frame. These pads are attached in a manner that does not allow for accidental or incidental removal; providing the highest level of involuntary impact protection. In addition, the pad set does not impede articulation of the bed frame.

Background

Hospital beds are used to treat a multitude of patient populations, at times the end user or occupant, hereinafter referred to as the "patient," may need additional protection from injuries during movements that may cause part of the body to strike the hospital bed rail, headboard and footboard. At times, these patients can be temporarily disoriented, or may have a neuromuscular disease which causes involuntary spasm, or seizure which can cause bodily harm when a portion of their body contacts a hard surface. The creation of an aesthetically pleasing, durable, reusable, protective pad system is required to protect such patients from unintentionally injuring themselves.

SUMMARY

A pad assembly for an occupant platform having rails. The pad assembly includes a foam pad comprising an outward portion that covers an outward face of one rail and a top portion that covers a top end of the one rail. The pad assembly also includes an inner casing that encases and is attached to the foam pad and an outer cover that covers the inner casing. The outer cover has a fastener for securing the pad assembly to the one rail.

The foam pad may include an outward first layer of foam fabricated from a high-density foam sheet laminated to a second layer of foam fabricated of a second high-density foam sheet, the first layer of foam being cut to an overall interior side profile shape of the rail and serves as a protective barrier between an occupant and an interior face of the rail, the second layer of foam being cut to an overall top and side profile of the same rail allowing the foam pad to rest inside of and on-top of the rail simultaneously.

The inner casing may include a form fitted, sealed, waterproof, textile covering to keep the foam pad contained within clean, sanitary, and dry. The inner casing may have one of a hook and loop fastener attached to the inner casing and the other of the hook and loop fastener is attached to a top edge of the side rail to effect a non-slip positioning of the foam pad assembly to the rail.

The outer cover may include a water-proof, stain-resistant, wipeable, industrial textile fabric backed with a low-density foam, and lined with waterproof anti-sheer fabric to form an outward face. The outer cover may further include a translucent, flexible, vinyl window to allow for operation and observation of occupant platform controls. In some embodiments the outer cover may include a zipper fastener along an edge of the outer cover and a snap fastener disposed underneath the rail, the snap fasteners comprising a flap that fold under the rail, and cooperative snaps or a long flap that extends from a bottom edge of the pad assembly and rests between a deck of the occupant platform and a mattress lying on the top face of the deck to secure the pad assembly to the rail.

BRIEF DESCRIPTION OF THE DRAWINGS

The embodiments will be described in detail with reference to the following drawings in which like reference numerals refer to like elements wherein.

DETAILED DESCRIPTION

Figure 1:
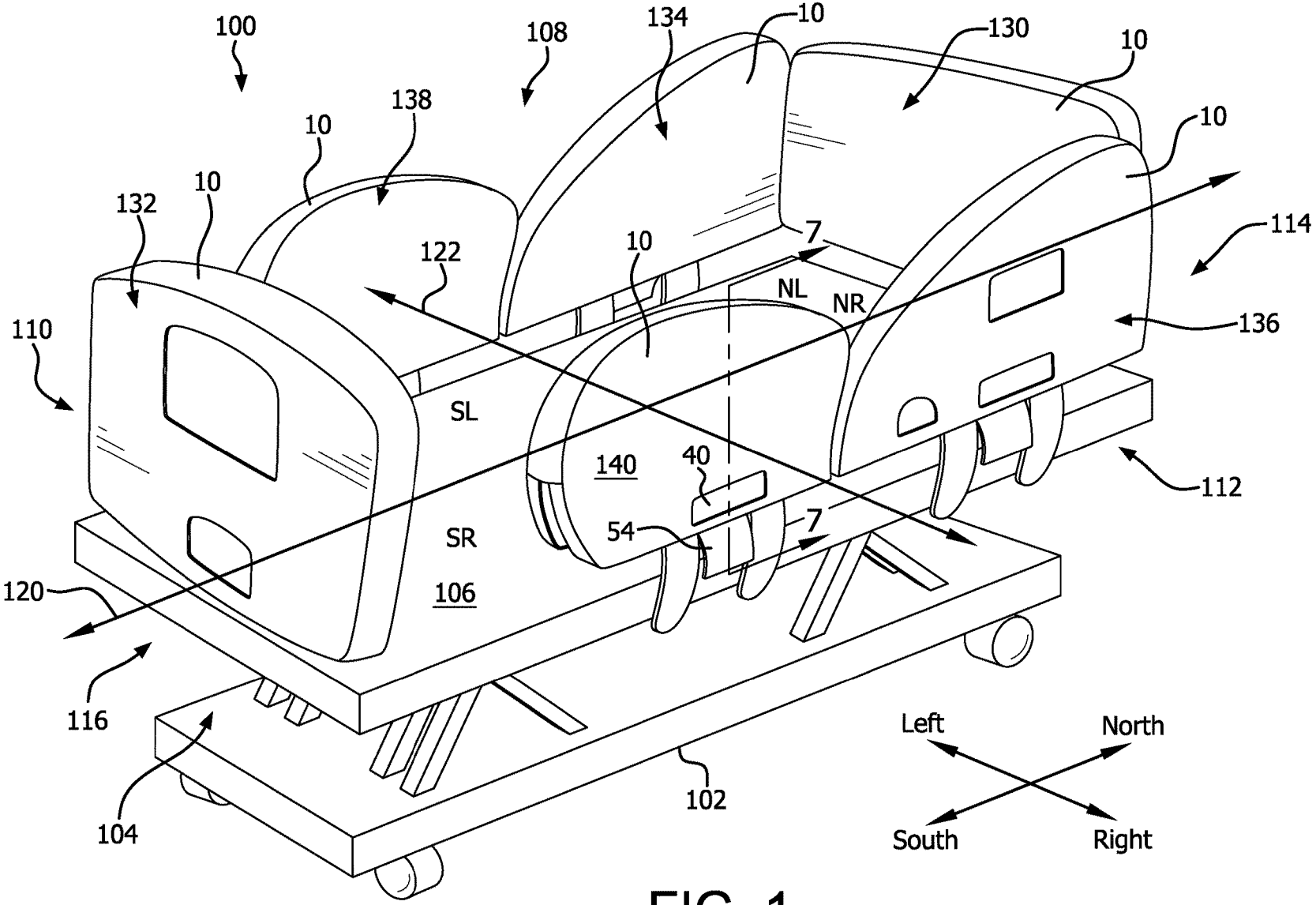
FIG. 1 is a front isometric view of the present invention shown on the rails an occupant platform.
Figure 2:
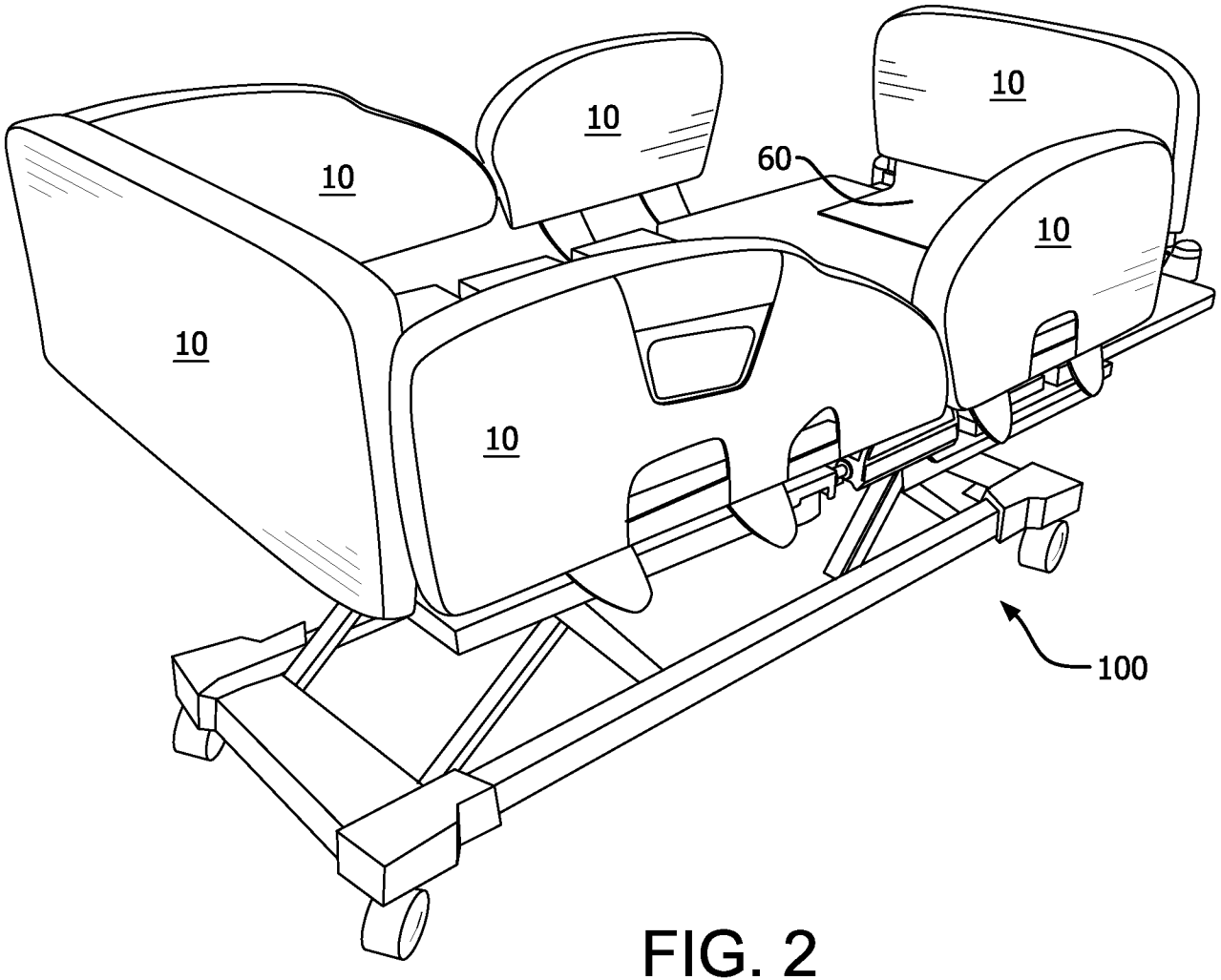
FIG. 2 is a rear isometric view of the present invention shown on the rails of an occupant platform.
Figure 3:
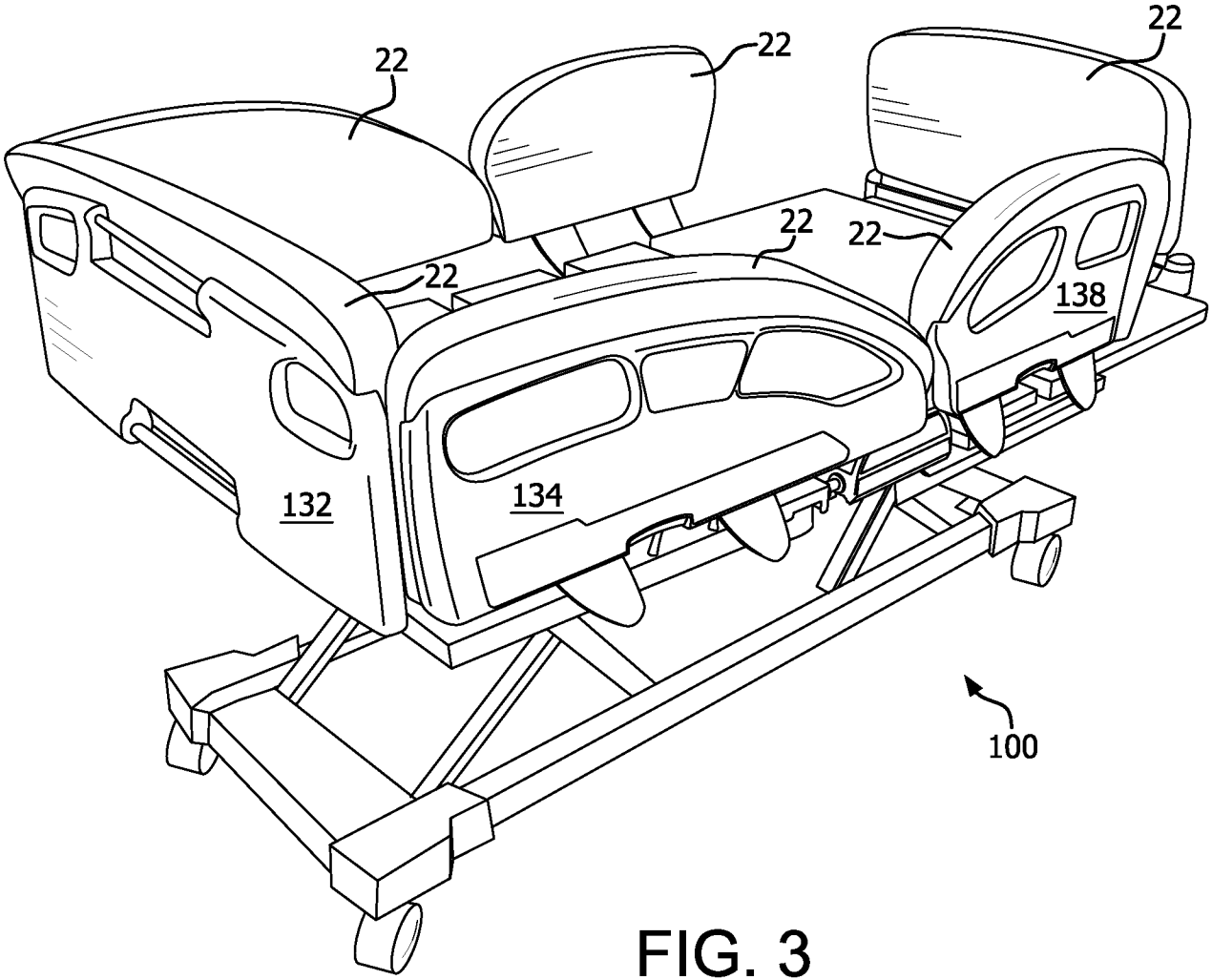
FIG. 3 is a rear isometric view of the present invention shown on the rails of an occupant platform with the textile covers removed.
Figure 4:
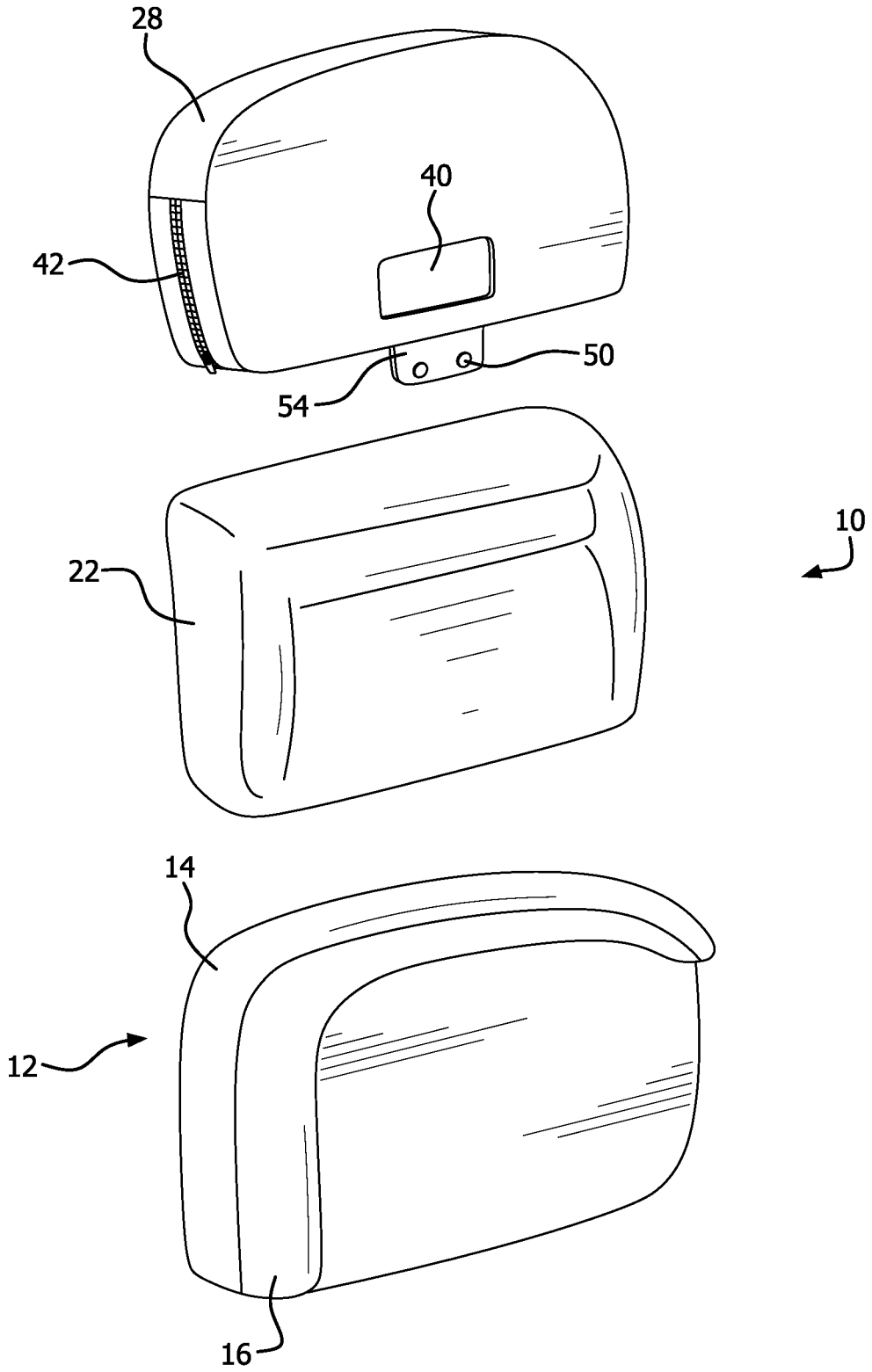
FIG. 4 is an exploded view of the pad assembly in accordance with the present invention.

Referring now to FIGS. 1 through 3, a set of pads or pad assemblies 10 is shown attached to the rails of an occupant support, such as hospital bed 100. The set of pads or pad assemblies 10 comprises twelve (12) individual pad assemblies as described in greater detail below, which when assembled completely envelop all four (4) side rails and the head and foot boards of the hospital bed, as best seen in FIG. 4.

As best seen in FIG. 3, the occupant support exemplified by a hospital bed 100 comprises a base frame 102, an elevatable frame 104 supported on the base frame 102, a deck 106 supported on the elevatable frame, and a plurality of rails 108. Typically, the illustrated deck is a segmented deck comprising segments for each body section such as a torso or upper body section, a seat section, a thigh section, a calf section, and the like. The angular orientations of at least some of the deck sections are typically adjustable. The bed extends laterally from a left side 110 to a right side 112 and longitudinally from a head end 114 to a foot end 116. In the present application, the terms "left" and "right" are from the perspective of an observer at the foot of the bed looking headwardly.

The illustration also shows longitudinally and laterally extending centerlines 120, 122. The longitudinal centerline defines laterally adjacent left and right sectors. The lateral centerline defines longitudinally adjacent head and foot sectors which are also referred to as north and south sectors. Collectively, the two centerlines define four regions, a north left region NL, a north right region NR, a south left region SL, and a south right region SR.

The bed 100 also typically includes a base mattress assembly (not shown) The base mattress exhibits enough flexibility to conform to the profile defined by the orientation adjustable deck sections. Various mattress constructions may be used. These include but are not limited to mattresses that employ foam, inflatable bladders, or a combination of foam and inflatable bladders.

The bed 100 also typically includes a plurality of rails 108. The plurality of rails 108 includes a head end or headboard rail 130, a foot end or footboard rail 132, an NL region siderail 134, an NR region siderail 136, an SL region siderail 138, and an SL region siderail 140.

FIGS. 4-7 shows an exemplary foam pad 12, representative of the twelve individual foam pads which comprise the present invention. The pad assembly 10 for rail 140 will be used to show an exemplary pad assembly. Typically, each foam pad 12 comprises a first pad sheet 14, a second pad sheet 16, and an encasement 18. The first pad sheet 14 is typically high-density foam (78-88 IFD) sheet 14, about 1.5" in thickness. The first pad sheet 14 is preferably laminated to the second pad sheet 16 preferably fabricated from a similar or the same foam material for an overall thickness of about 3" inches. One skilled in the art recognizes that other thicknesses may be suitable depending upon the application.

Figure 5:
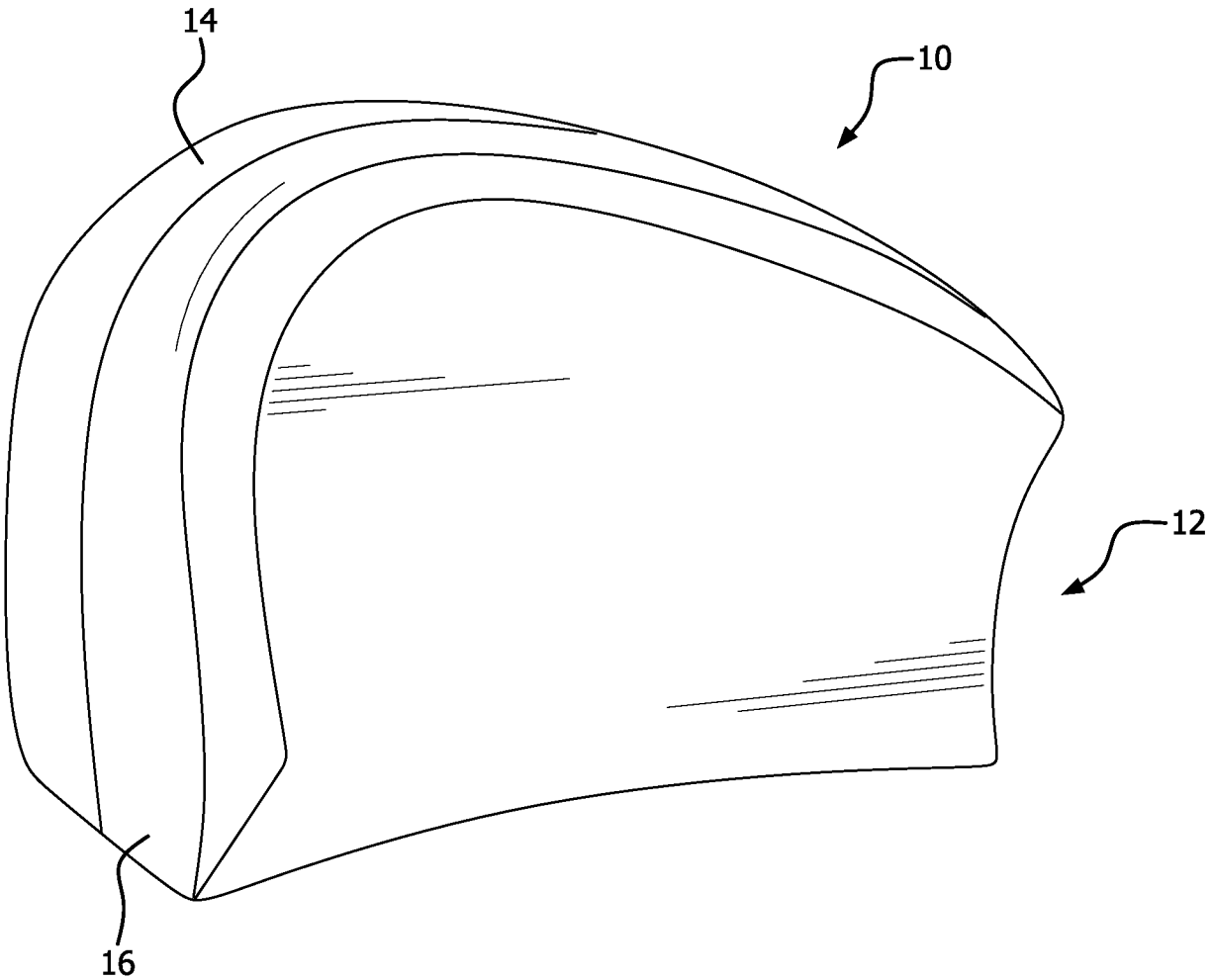
FIG. 5 is a side schematic view of the foam pad of the pad assembly of FIG. 4.

The first pad sheet 14 is shaped to the overall interior side profile shape of each specific rail shell and serves as a protective barrier between the patient and the interior face of the particular rail. The second pad sheet 16 is attached, such as by a lamination process, to the first pad sheet 14 and is shaped to the overall top and side profile of the same rail forming the pad assembly 12. This allows the pad assembly 12 to rest inside of and on-top of the rail simultaneously, as best seen in FIGS. 5-6.

The laminated foam pad assembly 12 is encased in, and attached to a form fitted, sealed, waterproof, textile covering 22, preferably 70D nylon, intended to keep the foam pad assembly 12 contained within in a clean, sanitary, and dry condition. As best seen in FIG. 7, the encasement 22 comprises a strip of loop fastener 24 which is mechanically stitched to the covering textile to form a permanent bond. The loop fastener 24 is preferably an inch in width though other widths are fall within the scope of the present invention based on such factors as durability, permanence of attachment, and the like. The loop fastener 24 mates with a hook fastener 26 that is typically attached via self-adhesive or the like to the top edge of the side rail during initial installation. This hook and loop fastener ensures a non-slip positioning of the encased foam assembly 12 to the rail, as best seen in its connected state in FIGS. 6 and 7.

This method and construction apply to five (5) of six pads, specifically the left and right head, the left and right foot rails, and the headboard of the set.

Figure 6:
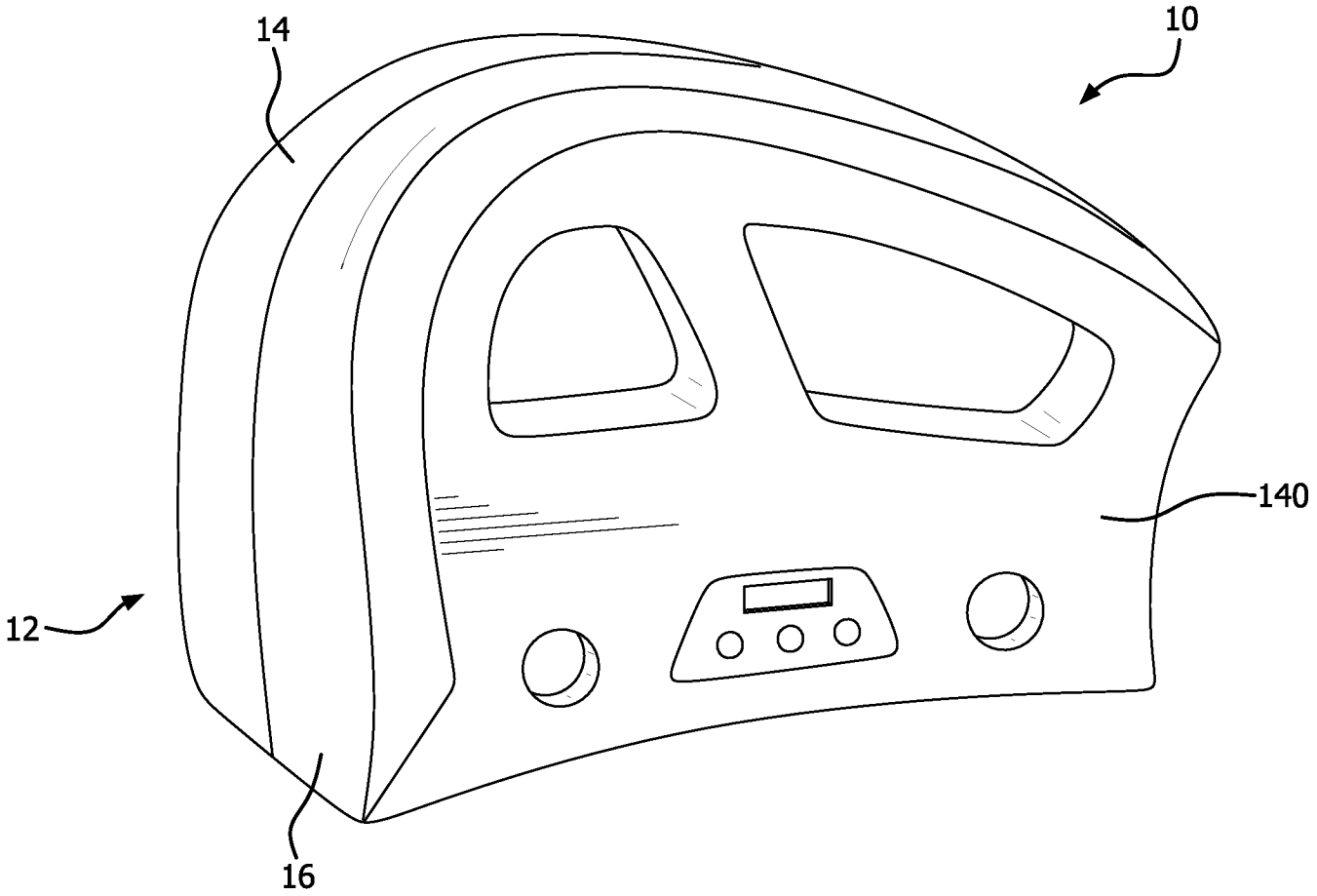
FIG. 6 is a side schematic view of the foam pad of the pad assembly of FIG. 4 attached to a rail.
Figure 7:
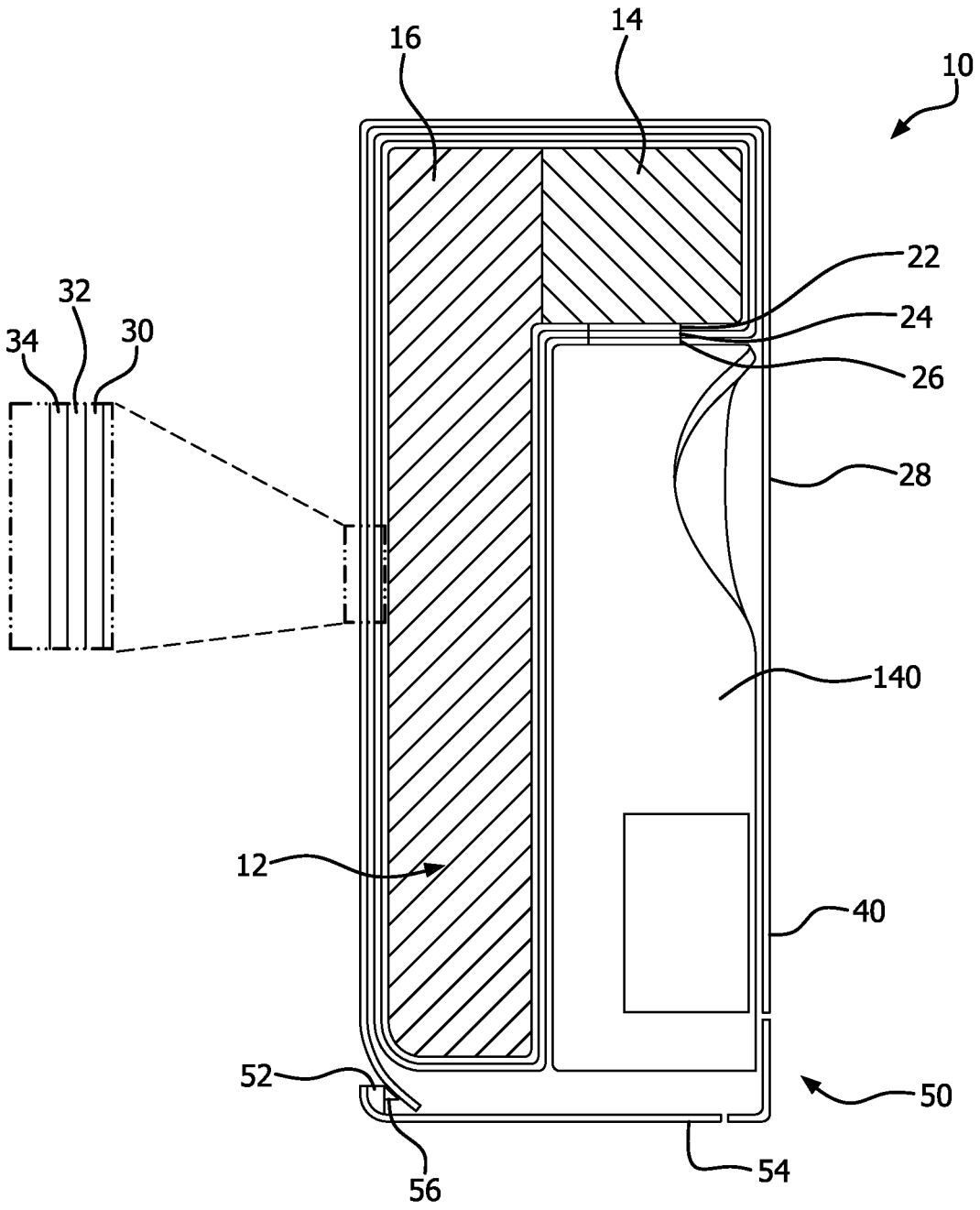
FIG. 7 is a cross-sectional view of the pad assembly of FIG. 4 along line 7-7.

Each encased pad assembly 12, once attached to its commensurate rail, as shown in FIGS. 6 and 7, is then covered with a cover assembly 28 as best seen in FIG. 7. The cover assembly 28 is typically constructed of a water-proof, stain-resistant, wipeable, industrial textile fabric 30, such as preferably Douglass independence 100% vinyl, backed with a mechanical attachment, such as glue, ultra-sonically welded, fastened, or the like, thin, low-density foam 32, such as preferably 55-65 IFD, to reduce wrinkling and improve fitment. The entire cover assembly is then lined with waterproof anti-sheer fabric 34, such as preferably 200D nylon, to allow for ease of installation, and emergency removal if required.

Each cover assembly 28 features may also include a translucent, flexible, vinyl window 40 to allow for operation and observation of critical bed functions (such as inclinometers, safety indications, user controls, and specialized branding marks). The cover assembly is form-fitted to the overall profile of the rail(s), and is attached by a heavy-duty zipper or similar removable fastener 42, along the thin edge of the cover assembly 28. Additional snap fasteners 50 are provided for attaching the cover assembly 28 underneath the rail. The snap fasteners 50 comprise snaps 52 which are attached to flaps 54 that fold under the shell, and attach back onto cooperative snaps 56.

The foam pad assembly 10 for the foot board is constructed of the same or similar materials, and in the same manner, as the other pieces, but is sculpted to follow the aesthetics of the bed frame. The cover assembly for the foot board is preferably encased foam assembly is also constructed of the same cover materials as the other parts in the set, but does not have a zipper or snaps. Instead, a long "flap" or "tail" 60 is stitched into the back side of the foot board pad cover assembly. This "tail" is preferably placed flat on the deck of the bed, and rests between the bed deck, and the mattress lying on the deck. This placement allows for secure installation without mechanical fasteners, or the ability for the foot board pad cover to be accidentally, or incidentally removed by the patient while lying in bed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A pad assembly for an occupant platform having rails comprising:

a foam pad comprising an outward portion that covers an outward face of one rail and a top portion that covers a top end of the one rail;

an inner casing that encases and is attached to the foam pad; and an outer cover that covers the inner casing, the outer cover has a fastener for securing the pad assembly to the one rail.

2. The pad assembly according to claim 1 wherein the foam pad comprises an outward first layer of foam fabricated from a high-density foam sheet laminated to a second layer of foam fabricated of a second high-density foam sheet, the first layer of foam being cut to an overall interior side profile shape of the one rail and is configured to serve as a protective barrier between an occupant and an interior face of the one rail, the second layer of foam being cut to an overall top and side profile of the same rail allowing the foam pad to rest inside of and on top of the one rail simultaneously.

3. A pad assembly as set forth in claim 1, wherein the inner casing comprises a form fitted, sealed, waterproof, textile covering to keep the foam pad contained within clean, sanitary, and dry.

4. A pad assembly as set forth in claim 2, wherein the inner casing comprises a form fitted, sealed, waterproof, textile covering to keep the foam pad contained within clean, sanitary, and dry.

5. A pad assembly as set forth in claim 1, wherein the inner casing has one of a hook and loop fastener attached to the inner casing and the other of the hook and loop fastener is attached to a top edge of the one rail to effect a non-slip positioning of the foam pad assembly to the one rail.

6. A pad assembly as set forth in claim 4, wherein the inner casing has one of a hook and loop fastener attached to the inner casing and the other of the hook and loop fastener is attached to a top edge of the one rail to effect a non-slip positioning of the foam pad assembly to the one rail.

7. A pad assembly as set forth in claim 1, wherein the outer cover comprises a water-proof, stain-resistant, wipe-able, industrial textile fabric backed with a low-density foam, and lined with waterproof anti-sheer fabric to form an outward face.

8. A pad assembly as set forth in claim 6, wherein the outer cover comprises a water-proof, stain-resistant, wipe-able, industrial textile fabric backed with a low-density foam, and lined with waterproof anti-sheer fabric to form an outward face.

9. A pad assembly as set forth in claim 1, wherein the outer cover includes a translucent, flexible, vinyl window to allow for operation and observation of occupant platform controls.

10. A pad assembly as set forth in claim 9 wherein the outer cover further comprises a zipper fastener along an edge of the outer cover and snap fasteners disposed underneath the one rail, the snap fasteners comprising a flap that folds under the one rail, and cooperative snaps.

11. A pad assembly as set forth in claim 1 wherein the outer cover further comprises a long flap that extends from a bottom edge of the pad assembly and rests between a deck of the occupant platform and a mattress lying on the top face of the deck to secure the pad assembly to the one rail.

12. A pad assembly as set forth in claim 8, wherein the outer cover includes a translucent, flexible, vinyl window to allow for operation and observation of occupant platform controls.

13. A pad assembly as set forth in claim 12 wherein the outer cover further comprises a zipper fastener along an edge of the outer cover and a-snap fasteners disposed underneath the one rail, the snap fasteners comprising a flap that folds under the one rail, and cooperative snaps.

14. A pad assembly as set forth in claim 8 wherein the outer cover further comprises a long flap that extends from a bottom edge of the pad assembly and rests between a deck of the occupant platform and a mattress lying on the top face of the deck to secure the pad assembly to the one rail.

15. The pad assembly according to claim 1 wherein the foam pad comprises a first pad sheet.

16. The pad assembly according to claim 1 wherein the foam pad comprises an outward first layer of foam fabricated from a high-density foam sheet laminated to a second layer of foam fabricated of a second high-density foam sheet.

17. An occupant platform comprising:

a base, an occupant platform attached to the base and a plurality of rails extending upwardly from the occupant platform and a pad assembly disposed on each rail, each pad assembly comprising a foam pad comprising an outward first layer of foam fabricated from a high-density foam sheet laminated to a second layer of foam fabricated of a second high-density foam sheet, the first layer of foam being cut to an overall interior side profile shape of the respective rail and is configured to serve as a protective barrier between the occupant and an interior face of the rail, the second layer of foam being cut to an overall top and side profile of the respective rail allowing the foam pad to rest inside of and on top of the respective rail simultaneously; an inner casing that encases and is attached to the foam pad, the inner casing having one of a hook and loop fastener attached to the inner casing and the other of the hook and loop fastener is attached to a top edge of the respective rail to effect a non-slip positioning of the foam pad assembly to the respective rail; and an outer cover that covers the inner casing, the outer cover has a fastener for securing the pad assembly to the respective rail.

18. The pad assembly according to claim 17 wherein the foam pad comprises a first pad sheet.

19. The pad assembly according to claim 17 wherein the foam pad comprises an outward first layer of foam fabricated from a high-density foam sheet laminated to a second layer of foam fabricated of a second high-density foam sheet.

* * * * *